United States Patent [19]

Vigg

[11] Patent Number: 4,672,982

[45] Date of Patent: Jun. 16, 1987

[54] PROCESS FOR THE PRODUCTION OF A SMOKING MATERIAL FROM CIGARETTE MAKER WINNOWINGS AND APPARATUS

[75] Inventor: Peter Vigg, Andover, England

[73] Assignee: AMF Incorporated, Minneapolis, Minn.

[21] Appl. No.: 770,380

[22] Filed: Aug. 29, 1985

Related U.S. Application Data

[63] Continuation of Ser. No. 574,111, Jan. 26, 1984, abandoned.

[30] Foreign Application Priority Data

Feb. 8, 1983 [GB] United Kingdom ..... 8303412

[51] Int. Cl.[4] ..... A24B 5/02; A24B 5/04; A24B 5/16; A24B 5/10

[52] U.S. Cl. ..... 131/290; 131/311; 131/312; 131/313; 131/324

[58] Field of Search ..... 131/324, 290, 311, 313, 131/324, 327, 105, 312

[56] References Cited

U.S. PATENT DOCUMENTS

| | | | |
|---|---|---|---|
| 3,219,042 | 11/1965 | Molins | 131/324 |
| 4,210,157 | 7/1980 | Kohnhurst et al. | 131/290 |
| 4,392,501 | 7/1983 | Newton et al. | 131/290 |

*Primary Examiner*—V. Millin

*Attorney, Agent, or Firm*—Willian Brinks Olds Hofer Gilson & Lione

[57] ABSTRACT

A process for converting cigarette tobacco winnowings into usable form for cigarette making, comprises crushing the winnowings, which have a moisture content compatible with cigarette making, effecting a first sieving operation on the resulting crushed winnowings, and effecting a second sieving operation on the smaller fraction resulting from the first sieving operation to remove particles unsuitable for direct use. Any larger fraction resulting from the first sieving operation may be subjected to cutting and thereafter a third sieving operation.

Suitable apparatus for converting cigarette tobacco winnowings having a moisture content compatible with cigarette making into usable form for cigarette making, comprises crushing rollers (11, 12) to which the winnowings are fed, a sieve (18) arranged to receive the crushed winnowings from the crusher, and a second sieve (19) provided to separate the tobacco usable for cigarette making from tobacco dust.

The apparatus may include a cutter (23, 24) for receiving and cutting the larger fraction of the sieved crushed winnowings.

The three operations of crushing, sieving and cutting are all advantageously performed on the tobacco at cigarette maker moisture. It is also performed at ambient pressure and temperature, thereby greatly reducing capital costs over processes requiring heating, cooling, pressurizing or moisture variation.

11 Claims, 1 Drawing Figure

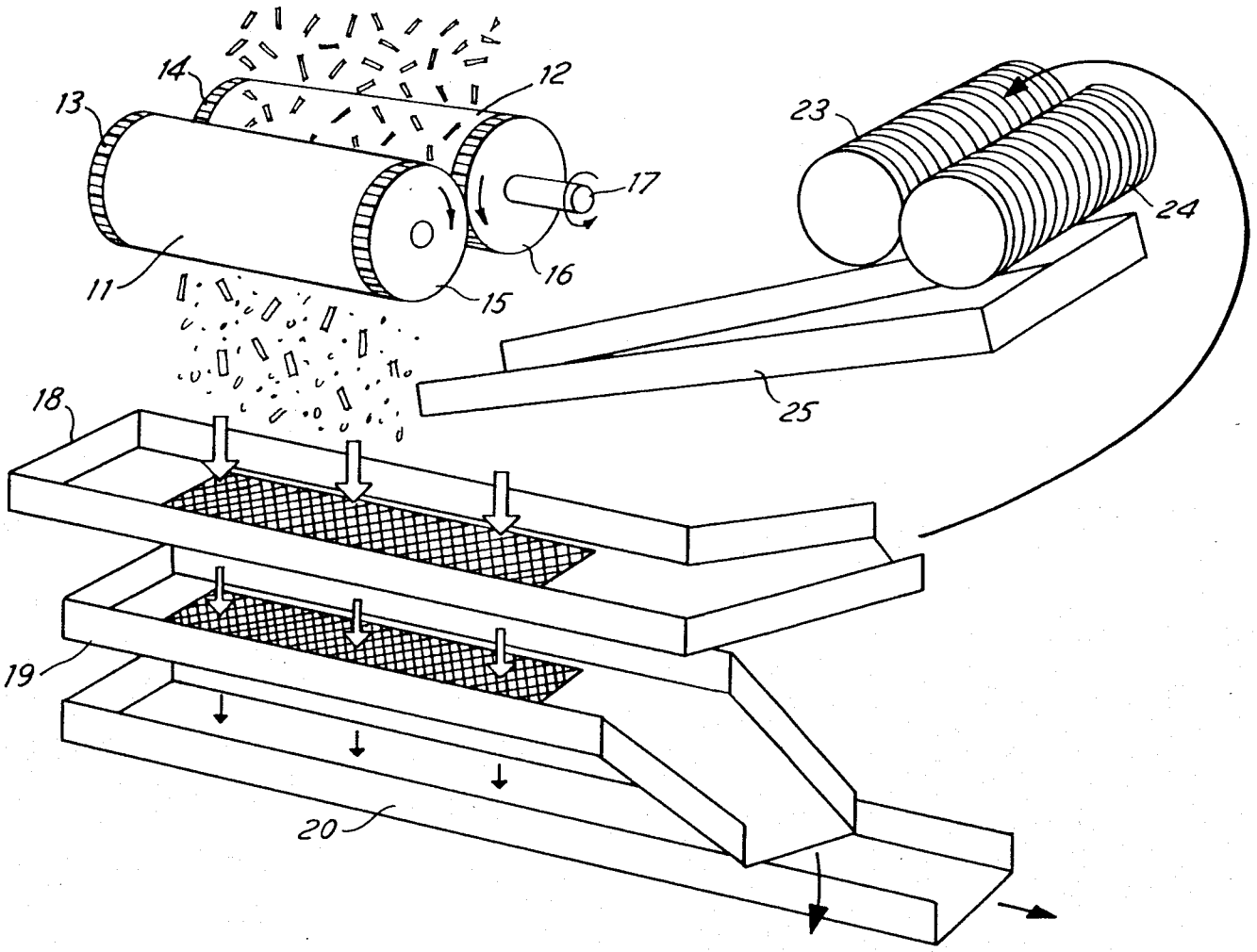
24
23
25
17
16
12
15
14
13
11
18
19
20

PROCESS FOR THE PRODUCTION OF A SMOKING MATERIAL FROM CIGARETTE MAKER WINNOWINGS AND APPARATUS

This application is a continuation of application Ser. No. 574,111, filed Jan. 26, 1984, now abandoned.

BACKGROUND TO THE INVENTION

The invention relates to a process for the production of a smoking material, for example, tobacco for use in cigarettes, and an apparatus for carrying out this process.

Cigarette maker winnowings typically make up approximately 1% of the total tobacco production and comprise mainly coarsely cut pieces of stem, midrib or stalk, but can include some lamina and reconstituted sheet.

The winnowings are unsuitable for use in cigarettes due to their hard 'woody' nature, which, apart from giving poor burning characteristics tend to tear or pierce the cigarette wrapping.

STATEMENT OF PRIOR ART

A known method of using winnowings is to reduce it to dust and then to use the dust in the manufacture of reconstituted sheet, resulting in the winnowings passing through the whole conditioning/cutting process a second time.

OBJECT OF THE INVENTION

An object of the invention is to provide a method of preparing the cigarette maker winnowings without any further conditioning being required, such that they may be directly recombined with the tobacco flow to the cigarette makers.

SUMMARY OF THE INVENTION

According to the invention there is provided a process for converting cigarette tobacco winnowings into usable form for cigarette making comprising crushing the winnowings, which have a moisture content compatible with cigarette making, effecting a first sieving operation on the resulting crushed winnowings, and effecting a second sieving operation on the smaller fraction resulting from the first sieving operation to remove tobacco dust, thereby producing a usable fraction.

In this manner the winnowings are, at maker moisture content (i.e. approximately 14%), reduced to a size and form suitable for addition to conventionally produced lamina and stalk for use in cigarette manufacture.

Further according to the invention there is provided apparatus for converting cigarette tobacco winnowings, having a moisture content compatible with cigarette making, into usable form for cigarette making comprising crushing rollers to which the winnowings are fed, a sieve arranged to receive the crushed winnowings from the crusher, and a second sieve provided to separate the tobacco usable for cigarette making from tobacco dust.

The invention also concerns a process of manufacturing cigarette tobacco comprising threshing tobacco leaf to remove the laminae from the stems and ribs, classifying the threshed tobacco, cutting the classified laminae and stem separately to sizes suitable for cigarette manufacture, blending the cut laminae and cut stem, and conditioning to provide a main body of cut tobacco, using the main body of cut tobacco in a cigarette maker which include means for ejecting coarse particles (winnowings), crushing the coarse particles ejected by the maker, effecting a first sieving operation on the resulting crushed winnowings, passing the larger fraction resulting from said first sieving operation to a cutter, cutting the larger fraction by means of said cutter, effecting a second sieving operation on the resulting cut larger fraction, effecting a third sieving operation on the smaller fraction resulting from the second sieving operation to remove dust particles, and conveying the larger fraction of tobacco which results from the third sieving operation to the main body of cut tobacco.

BRIEF DESCRIPTION OF DRAWINGS

The invention will now be described by way of example with reference to the accompanying drawing showing a schematic perspective view of the crusher, shredder and sieves.

DESCRIPTION OF PREFERRED EMBODIMENTS

The winnowings, which may be stems, midribs and veins with or without small pieces of lamina attached, or pieces of lamina or reconstituted sheet, are fed, either by gravity or by powered means, between two contrarotating rollers 11, 12 at a pinch gap of typically zero millimeters, but may be as large as 1.0 millimeters. The rollers are provided at their ends with meshing gear wheels 13, 14 and 15, 16 of which one, 16, is driven by shaft 17.

After passing through the rollers, the tobacco is conveyed, either by gravity or by powered means, to a series of sieves 18, 19.

Sieving is carried out in three stages. Firstly, the tobacco is graded into particles passing through the sieve 18 of aperture size preferably between 6 mm. and 1 mm. (the first sieving operation).

The tobacco passing through the first sieve 18 is sieved on the second sieve 19 of aperture size preferably between 4 mm. and 150 microns (most desirably substantially 850 microns).

Tobacco passing through the second sieve 19 may be deemed to be too small for use in cigarettes and may be passed on by a chute 20 to be made into reconstituted sheet.

Tobacco remaining on the second sieve 19 is deemed to be suitable for direct addition into the tobacco flow line for use in making cigarettes.

Tobacco remaining on the first sieve 18 is deemed too large for direct use in cigarettes and is conveyed to a size reduction stage of the apparatus.

Size reduction of the flattened winnowings which have not passed through the first sieve 18 is effected by a cutter 20 comprising two series 23, 24 of contrarotating overlapping steel disks of thickness typically between 0.10 mm. and 2.0 mm. (most desirably substantially 0.8 mm). The outer periphery of the disks may be cylindrical, serrated or have suitable cut outs to assist the material feed. The cutting disks may be interspaced by fixed members, which also guide the winnowings through the cutting zone. The flattened winnowings are fed to the cutter, either by gravity or by powered means.

The cut product is then conveyed back to the first sieve 18 of the two stage sieve via a chute 25 where it is again graded (second sieving operation). Any product which is still too large is recirculated through the cutter until it is of a size suitable for use in cigarette manufacture, or has been reduced to dust.

The product may be further processed to enhance the filling power (cc/gram) typically by using one of the known processes for expanding tobacco (e.g. British Pat. Nos: 1431123, 1,570,270 Philips Morris). This improvement process may be performed either before the crushing process or after the sieving process.

The three operations of crushing, sieving and cutting are all advantageously performed on the tobacco at cigarette maker moisture content. It is also performed at ambient pressure and temperature, thereby greatly reducing capital costs over processes requiring heating, cooling, pressurising or moisture variations.

Flattening the winnowings by crushing ensures that the cut winnowings are pliable enough to be used in cigarette manufacture with minimal possibilities of their puncturing the cigarette papers.

In this way winnowings from the maker may be processed into a usable form for cigarette making. Since the winnowings are already conditioned at cigarette maker moisture content the processed winnowings can be returned to the main body of cut tobacco resulting from threshing, classification, cutting, blending and conditioning.

I claim:

1. A process for converting cigarette tobacco winnowings into usable form for cigarette making comprising:

(a) crushing the winnowings, which have a moisture content compatible with cigarette making:

(b) effecting a first sieving operation on the resulting crushed winnowings;

(c) effecting a second sieving operation on the smaller fraction resulting from the first sieving operation to remove tobacco dust, thereby producing a usable fraction;

(d) cutting to desired size for cigarette making the larger fraction that did not pass said first sieving operation; and (e) effecting a third sieving operation on said cut larger fraction that did not pass the first sieving operation.

2. Apparatus for converting cigarette tobacco winnowings having a moisture content compatible with cigarette making into usable form for cigarette making comprising:

(a) crushing rollers to which the winnowings are fed;

(b) a sieve arranged to receive the crushed winnowings from the crusher;

(c) a second sieve provided to separate the tobacco usable for cigarette making from tobacco dust, (d) means for cutting to desired size for cigarette making the larger fraction that did not pass said first sieving operation;

(e) means for conveying said larger fraction that did not pass the first sieving operation to said cutting means; and (f) means for sieving said cut larger fraction that did not pass said first sieve.

3. Apparatus according to claim 2, wherein the crushing rollers have a clearance between them from 0 to 1 mm.

4. Apparatus according to claim 2 or 3, wherein means are provided to drive the crushing rollers in contrarotating fashion.

5. Apparatus according to claim 2, wherein the means for cutting comprises contra-rotating overlapping steel disks.

6. Apparatus according to claim 5, wherein the outer peripheries of the disks are cylindrical.

7. Apparatus according to claim 5, wherein the outer peripheries of the disks are serrated

8. Apparatus according to claim 5, wherein the outer peripheries of the disks are provided with cut-outs to asist conveying of the tobacco.

9. In a process of manufacturing cigarette tobacco including threshing tobacco leaf to remove the lamina from the stems and ribs; classifying the threshed tobacco; cutting the classified laminae and stem separately to sizes suitable for cigarette manufacture; blending to cut laminae and cut stem, and conditioning to provide a main body of cut tobacco; and using the main body of cut tobacco in a cigarette maker which include means for ejecting coarse particles (winnowings);

the improvement comprising (a) crushing the coarse particles ejected by the maker;

(b) effecting a first sieving operation on the resulting crushed winnowings;

(c) passing the larger fraction resulting from said first sieving operation to a cutter;

(d) cutting the larger fraction by means of said cutter;

(e) effecting a second sieving operation on the resulting cut larger fraction;

(f) effecting a third sieving operation on the smaller fraction resulting from the second sieving operation; and (g) conveying the larger fraction of tobacco which results from the third sieving operation to the main body of cut tobacco.

10. The apparatus claimed in claim 2 wherein said means for sieving said cut larger fraction includes means for combining the cut larger fraction with the crushed winnowings from the crusher.

11. A process for converting cigarette tobacco winnowings into usable form for cigarette making comprising:

(a) crushing the winnowing, which have a moisture content compatible with cigarette making;

(b) effecting a first sieving operation on the resulting crushed winnowings;

(c) effecting a second sieving operation on the smaller fraction resulting from the first sieving operation to remove tobacco dust, thereby producing a usable fraction;

(d) cutting to desired size for cigarette making any larger fraction that did not pass said first sieving operation; and (e) combining said cut larger fraction that did not pass the first sieving operation with the crushed winnowings resulting from step (a) above.

* * * * *